US007582866B2

(12) United States Patent
Furuhashi et al.

(10) Patent No.: US 7,582,866 B2
(45) Date of Patent: Sep. 1, 2009

(54) ION TRAP MASS SPECTROMETRY

(75) Inventors: Osamu Furuhashi, Kyoto (JP); Kengo Takeshita, Kyoto (JP); Kiyoshi Ogawa, Kyoto (JP)

(73) Assignee: Shimadzu Corporation, Kyoto-Fu (JP)

( * ) Notice: Subject to any disclaimer, the term of this patent is extended or adjusted under 35 U.S.C. 154(b) by 51 days.

(21) Appl. No.: 11/866,794

(22) Filed: Oct. 3, 2007

(65) Prior Publication Data

US 2009/0090860 A1 Apr. 9, 2009

(51) Int. Cl.
*H01J 49/42* (2006.01)
*H01J 49/26* (2006.01)

(52) U.S. Cl. ..... 250/292; 250/282; 250/281; 250/290

(58) Field of Classification Search ..... 250/292, 250/282, 281, 290
See application file for complete search history.

(56) References Cited

U.S. PATENT DOCUMENTS

| | | | | |
|---|---|---|---|---|
| 6,949,743 | B1 * | 9/2005 | Schwartz | 250/290 |
| 7,102,129 | B2 * | 9/2006 | Schwartz | 250/292 |
| 2009/0032698 | A1 * | 2/2009 | Furuhashi et al. | 250/282 |

OTHER PUBLICATIONS

Lekha Sleno et al., "Ion Activation Methods for Tandem Mass Spectrometry", National Research Council, Institute for Marine Biosciences, Journal of Mass Spectrometry, Aug. 8, 2004, pp. 1091-1112, vol. 39.

O. Furuhashi et al., material published on May 1, 2007 and presented at a conference held May 15-17, 2007.

Kengo Takeshita et al., "Increasing fragment mass range by infrared multiphoton dissociation in a digital ion trap mass spectrometer", 55th ASMS Conference on Mass Spectrometry, American Society for Mass Spectrometry, Jun. 3-7, 2007.

Lekha Sleno et al., "Ion Activation Methods for Tandem Mass Spectrometry", National Research Council, Institute for Marine Biosciences, Journal of Mass Spectrometry, Aug. 8, 2004, pp. 1091-1111, vol. 39.

Anne H. Payne et al., "Thermally Assisted Infrared Multiphoton Photodissociation in a Quadrupole Ion Trap", Department of Chemistry, American Chemical Society, May 11, 2001, pp. 3542-3548, vol. 73.

* cited by examiner

*Primary Examiner*—Nikita Wells
(74) *Attorney, Agent, or Firm*—Sughrue Mion, PLLC

(57) ABSTRACT

Disclosed is an ion trap mass spectrometer for MS″ analysis, which comprises a frequency-driven ion trap section operable to trap sample ions and isolate a precursor ion from the sample ions, while setting an ion-trapping RF voltage waveform at a first frequency providing a first low-mass cutoff (LMCO) value, and, then after setting the ion-trapping RF voltage waveform at a second frequency greater than the first frequency to provide a second LMCO value less than the first LMCO value, without changing an amplitude of the ion-trapping RF voltage waveform, to irradiate the precursor ion in a trapped state with light so as to photodissociate the precursor ion into fragment ions; and an analyzer section operable to subject the fragment ions ejected from the ion trap section, to mass spectrometry so as to obtain information about a molecular structure of the precursor ion. The ion trap mass spectrometer of the present invention can maximize a mass range coverable in one cycle of MS″ analysis.

4 Claims, 4 Drawing Sheets

| | LMCO=50 | LMCO=300 |
|---|---|---|
| DIT | 500 V<br>1.17 MHz | 500 V<br>478 kHz |
| AIT | 116 V<br>500 kHz | 697 V<br>500 kHz |

| | LMCO=50 | LMCO=300 |
|---|---|---|
| DIT | 500 V<br>1.17 MHz | 500 V<br>478 kHz |
| AIT | 116 V<br>500 kHz | 697 V<br>500 kHz |

ION TRAP MASS SPECTROMETRY

BACKGROUND OF THE INVENTION

1. Field of the Invention

The present invention relates to the field of mass spectrometry, and more particularly to an ion trap mass spectrometer and an ion trap mass spectrometric method designed to cover a wide mass range in one cycle of $MS^n$ analysis.

2. Description of the Related Art

First of all, a $q_z$ value of an ion trap in an ion trap mass spectrometer, a m/z (mass-to-charge ratio) value of a target ion to be trapped, and a potential well depth $D_z$ to be sensed by a target ion, will be briefly described.

The $q_z$ value of the ion trap is a parameter defined by the following Formula 1:

$$q_z = \frac{4zV}{mr_0^2\Omega^2} \tag{1}$$

wherein: z is an electronic charge of a target ion; V is an amplitude of RF applied to the ion trap; m is a mass of the target ion; $r_0$ is an inscribed radius of the ring electrode of ion trap; and Ω is an angular frequency of the RF.

According to a theoretical result in a stable region, the ion trap has a $q_z$ value ranging from zero to 0.908 (if a sinusoidal wave is used as a trapping RF voltage waveform). As to a mass range of trappable ions, given that a m/z value of an ion trappable when $q_{z\ max}$=0.908 is a low-mass cutoff (LMCO) value, an ion having a m/z value greater than the LMCO value will be trapped.

The potential well depth $D_z$ to be sensed by a target ion is expressed as the following Formula 2:

$$D_z \propto q_z V \tag{2}$$

The $q_z$ value becomes smaller as a mass of trapped ions increases, as seen in the Formula 1. Accordingly, the potential well depth $D_z$ becomes smaller, as seen in the Formula 2 (see the following Table 1). If the potential well depth $D_z$ becomes smaller, an ion trapping efficiency will be lowered. This means that there is an effective upper limit on the mass range of trappable ions.

TABLE 1

Relationship of $q_z$ value, mass-to-charge ratio m/z and potential well depth $D_z$

| | | | |
|---|---|---|---|
| $q_z$ value | small (zero) | → | large ($q_{z\ max}$) |
| m/z | large | → | small (LMCO value) |
| $D_z$ | small | → | large |

In mass spectrometry, a collision-induced dissociation (CID) process is widely used as a technique for exciting and dissociating a molecular ion in an ion trap. The CID process is designed to accelerate an ion based on resonance excitation so as to dissociate the ion through a collision with an inert gas (e.g., He or Ar). In view of obtaining higher dissociation efficiency, it is necessary to increase the potential well depth $D_z$ to be sensed by a precursor ion (i.e., a target ion to be trapped), so as to allow the precursor ion to have higher kinetic energy. Typically, the LMCO value is set to be ⅓ to ¼ of a mass of a precursor ion. Therefore, a fragment ion having a mass less than ⅓ to ¼ of a mass of the precursor ion cannot be measured (see FIG. 1A).

As an alternative technique to the CID process, there has been known an infrared multiphoton dissociation (IRMPD) process designed to irradiate a molecular ion with high-intensity infrared light so as to vibrationally excite and cleave the molecular ion. As compared with the CID process, the greatest advantage of the IRMPD process is in that the dissociation efficiency is not dependent on the potential well depth $D_z$, and therefore the LMCO value can be lowered during infrared light irradiation to allow a fragment ion having a relatively small mass to be measured (see FIG. 1B). The IRMPD process is disclosed, for example, in "Ion activation methods for tandem mass spectrometry", Lekha Sleno and Dietrich A. Volmer, Journal of Mass Spectrometry, 39 (2004), 1091-1112, and "Thermally Assisted Infrared Multiphoton Photodissociation in a Quadrupole Ion Trap", Anne H. Payne and Gary L. Glish, Analytical Chemistry, 73 (2001), 3542-3548.

Although the IRMPD process theoretically has a wider mass range measurable at once as compared with the CID process, an actual measurable mass range based on conventional ion traps is not sufficiently wide in the existing circumstances. With a view to lowering the LMCO value, the conventional ion trap is designed to reduce an amplitude of a trapping RF sinusoidal voltage waveform while keeping a frequency of the voltage waveform (this type of ion trap will hereinafter be refereed to as "amplitude-driven ion trap"; the amplitude-driven ion trap employs a resonator for generating the sinusoidal voltage waveform, and thereby it is difficult to change the frequency). As a result, the potential well depth $D_z$ to be sensed by a precursor ion or a fragment ion is reduced to cause significant deterioration in ion trap efficiency.

SUMMARY OF THE INVENTION

In view of the above circumstances, it is an object of the present invention to provide an ion trap mass spectrometer and an ion trap mass spectrometric method, capable of increasing a mass range coverable in one cycle of $MS^n$ analysis.

In order to achieve the above object, according to a first aspect of the present invention, there is provided an ion trap mass spectrometer for $MS^n$ analysis, which comprises: a frequency-driven ion trap section operable to trap sample ions and isolate a precursor ion from the sample ions, while setting an ion-trapping RF voltage waveform at a first frequency providing a first low-mass cutoff (LMCO) value, and, then after setting the ion-trapping RF voltage waveform at a second frequency greater than the first frequency to provide a second LMCO value less than the first LMCO value, without changing an amplitude of the ion-trapping RF voltage waveform, to irradiate the precursor ion in a trapped state with light so as to photodissociate the precursor ion into fragment ions; and an analyzer section operable to subject the fragment ions ejected from the ion trap section, to mass spectrometry so as to obtain information about a molecular structure of the precursor ion.

According to a second aspect of the present invention, there is provided an ion trap mass spectrometric method for $MS^n$ analysis, which comprises the steps of: trapping sample ions and isolating a precursor ion from the sample ions, while setting an ion-trapping RF voltage waveform at a first frequency providing a first low-mass cutoff (LMCO) value; after setting the ion-trapping RF voltage waveform at a second frequency greater than the first frequency to provide a second LMCO value less than the first LMCO value, without changing an amplitude of the ion-trapping RF voltage waveform, irradiating the precursor ion in a trapped state with light so as to photodissociate the precursor ion into fragment ions; and subjecting the fragment ions to mass spectrometry so as to obtain information about a molecular structure of the precursor ion.

In the ion trap mass spectrometer or the ion trap mass spectrometric method of the present invention, the ion-trapping RF voltage waveform is preferably formed as a rectangular voltage waveform.

As above, in the present invention, under the condition that an amplitude of the ion-trapping RF voltage waveform is maintained at a constant value to keep a potential well depth at a relatively large value, a frequency of the ion-trapping RF voltage waveform is increased to lower the LMCO value (i.e., the ion trap section is configured as a frequency-driven ion trap). Thus, the potential well depth to be sensed by a precursor ion to be trapped under a lowed $q_z$ value can be kept at a relatively large value to allow a larger number of precursor ions to be trapped. Then, through irradiation with light, such as high-intensity infrared light, the precursor ions (i.e., molecular ions) in a trapped state are sufficiently cleaved, i.e., photodissociated, because the dissociation efficiency in the IRMPD process is not dependent on the potential well depth, as mentioned above. In addition, the potential well depth is also relatively large for fragment ions to be produced by photodissociation, and therefore a sufficient amount of fragment ions can be trapped. A combination of the frequency-driven ion trap and the IRMPD process makes it possible to perform a highly-sensitive MS″ analysis and expand a mass range coverable in one cycle of the MS″ analysis.

DETAILED DESCRIPTION OF THE EMBODIMENTS

Exemplary embodiments of the present invention will now be described.

An ion trap mass spectrometer for MS″ analysis, according to the exemplary embodiment of the present invention, fundamentally comprises an ion source section for generating sample ions, an ion trap section for trapping the sample ions generated by the ion source section, isolating (selecting) a precursor ion from the sample ions, and photodissociating the precursor ion in a trapped state into fragment ions, and an analyzer section for subjecting the fragment ions ejected from the ion trap section, to mass spectrometry so as to obtain information about a molecular structure of the precursor ion.

The ion trap mass spectrometer includes two types: one type adapted to sequentially eject respective ones of the fragment ions from the ion trap section while discriminating them on the basis of m/z value; and the other type adapted to eject all the fragment ions from the ion trap section at once and discriminate respective m/z values thereof on the basis of time-of-flight.

Figure 1A:
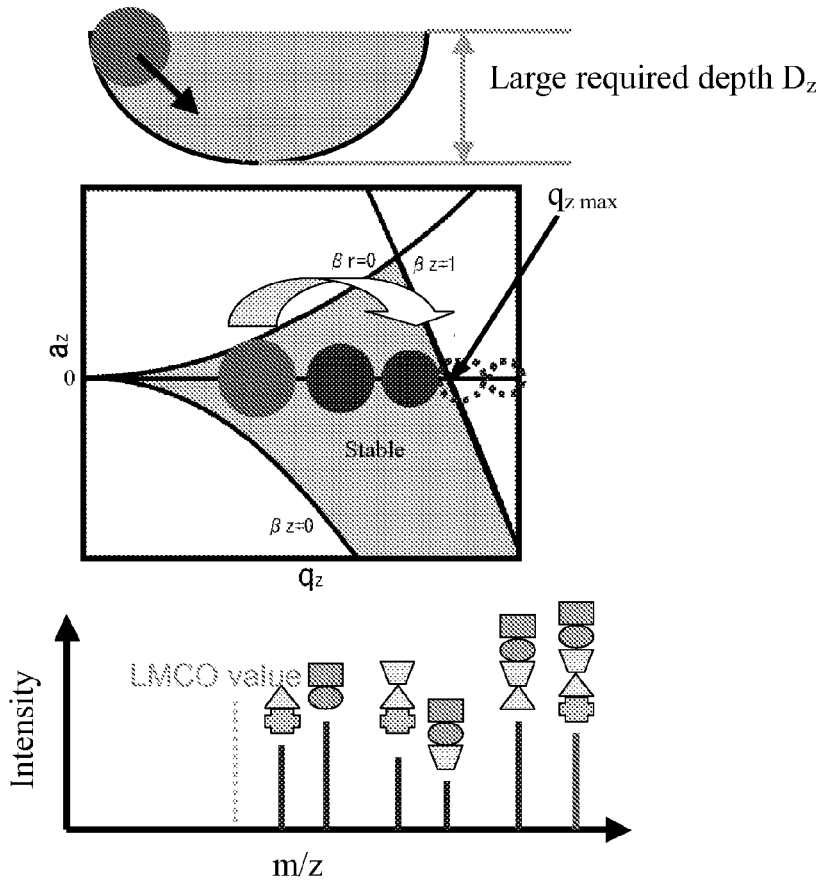
FIG. 1A Prior Art
FIGS. 1A and 1B are explanatory diagrams of a CID process and an IRMPD process, respectively.
Figure 1B:
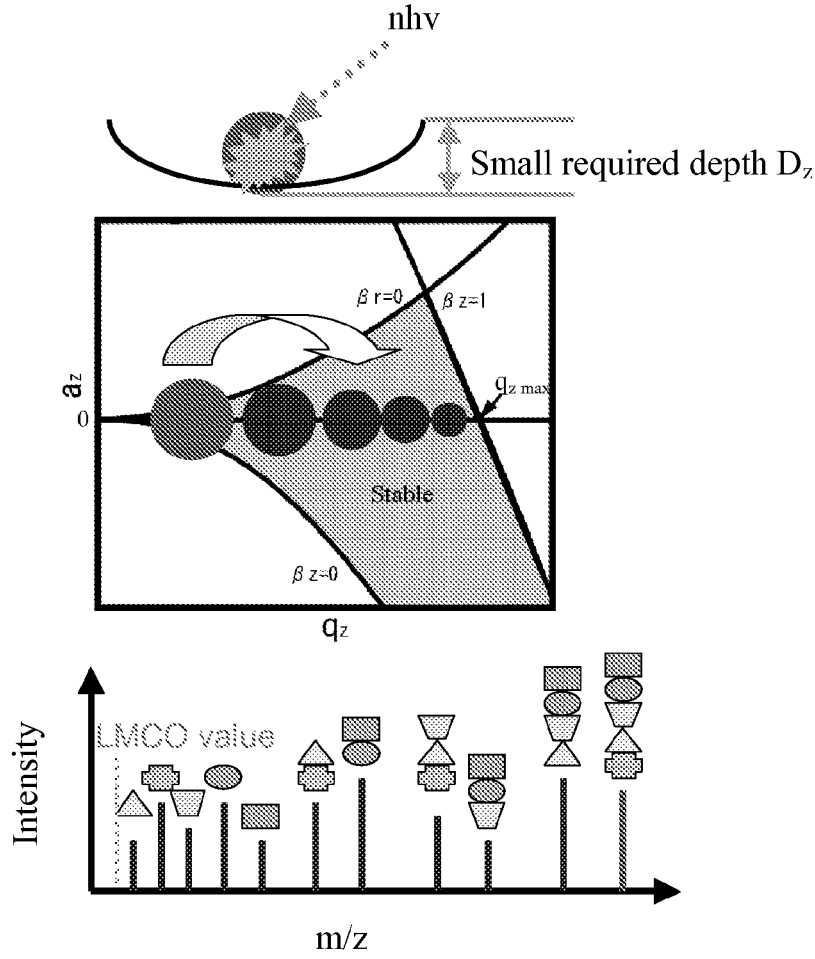
FIG. 1B Prior Art
Figure 2:
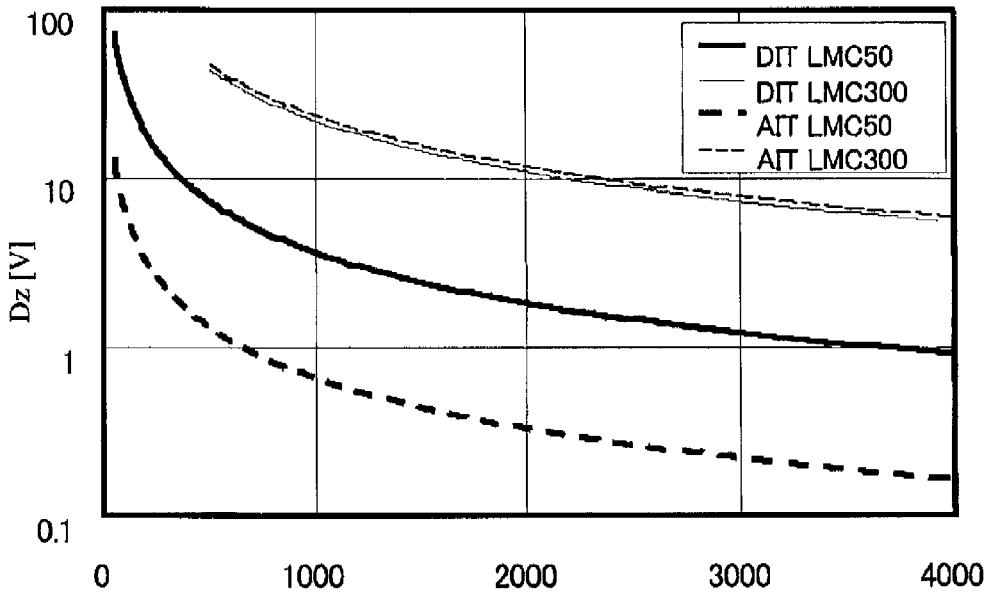
FIG. 2 is a graph showing respective potential well depths in a conventional ion trap using a sinusoidal RF voltage waveform and an ion trap of an exemplary embodiment using a rectangular RF voltage waveform, wherein the horizontal axis represents a mass of a trappable ion, and the vertical axis represents a potential well depth.

FIG. 2 shows computationally-estimated potential well depths in the conventional amplitude-driven ion trap designed to apply a sinusoidal RF voltage waveform with a variable amplitude to a ring electrode, and a frequency-driven ion trap designed to apply a rectangular RF voltage waveform with a variable frequency to a ring electrode, wherein a LMCO value is set at 50 Da and 300 Da. As shown in FIG. 2, in the amplitude-driven ion trap [i.e., analog ion trap (AIT)], the amplitude of the sinusoidal RF voltage waveform is adjusted while maintaining the frequency thereof at a constant value (e.g., 500 kHz; see an inserted chart of FIG. 2). By contrast, in the frequency-driven ion trap [i.e., digital ion trap (DIT)] according to the exemplary embodiment of the present invention, the frequency of the rectangular RF voltage waveform is adjusted while maintaining the amplitude thereof at a constant value (e.g., 500 V; see the inserted chart of FIG. 2). Specifically, when a low-mass cutoff (LMCO) value is set at 50 Da to measure a relatively low mass (m/z) range, the frequency-driven DIT can provide a larger potential well depth than that of the amplitude-driven AIT, over a wide mass range. Thus, the DIT can trap both a precursor ion and fragment ions with higher efficiency, and the IRMPD process can be performed with enhanced sensitivity so as to increase a mass range coverable in one cycle of MS″ analysis.

As a specific example, a monovalent ion (m/z: 3,495) of oxidized insulin B chain (bovine) was generated in the ion source section, and introduced into the ion trap section comprising a digital ion trap (DIT). In the present invention, during the process of introducing sample ions generated in the ion source section into the ion trap section, and isolating (selecting) a precursor ion from the sample ions, a frequency of a rectangular RF voltage waveform to be applied to the DIT is set at a first value providing a first LMCO value capable of obtaining a relatively large potential well depth to be sensed by the precursor ion, i.e., a relatively high LMCO value, so as to maximize the number of precursor ions to be trapped. Preferably, the first frequency is set to allow the first LMCO value to be slightly less than a m/z value of the precursor ion so as to maximize the number of precursor ions to be trapped. For example, in case of trapping a precursor ion with a m/z value of about 3500 Da, the first frequency is typically set to allow the first LMCO value to be about 3000 Da. However, in the present invention, the frequency of the RF voltage waveform is increased from the first value to a second value providing a second LMCO value, as will be described later. Thus, if the first and second LMCO values have an excessively large difference therebetween, a potential atmosphere will be rapidly changed to cause disappearance of precursor ions. Therefore, in this example, the first frequency was preferably set to allow the first LMCO value to be about 1000 Da.

After isolating (selecting) the precursor ion from the sample ions, the frequency of the rectangular RF voltage waveform was increased from the first frequency to a second value providing a second LMCO value of 90 Da. In the present invention, the second frequency is preferably set to allow the second LMCO value to be lowered enough to trap fragment ions (each having a m/z value less than that of the precursor ion) to be produced by a subsequent photodissociation. However, if the second LMCO is unduly lowered, the potential well depth for trapping the precursor ions (having a relatively large m/z value) will be excessively reduced to cause decrease in the number of trapped precursor ions (i.e., cause escape of a significant part of the trapped precursor ions from the ion trap section). In an experimental test using a molecular ion having a m/z value of 3500 Da as a precursor ion, it has been verified that a sufficient number of precursor ions can be kept in a trapped state even if the second LMCO value is lowered to 90 Da.

Figure 3:
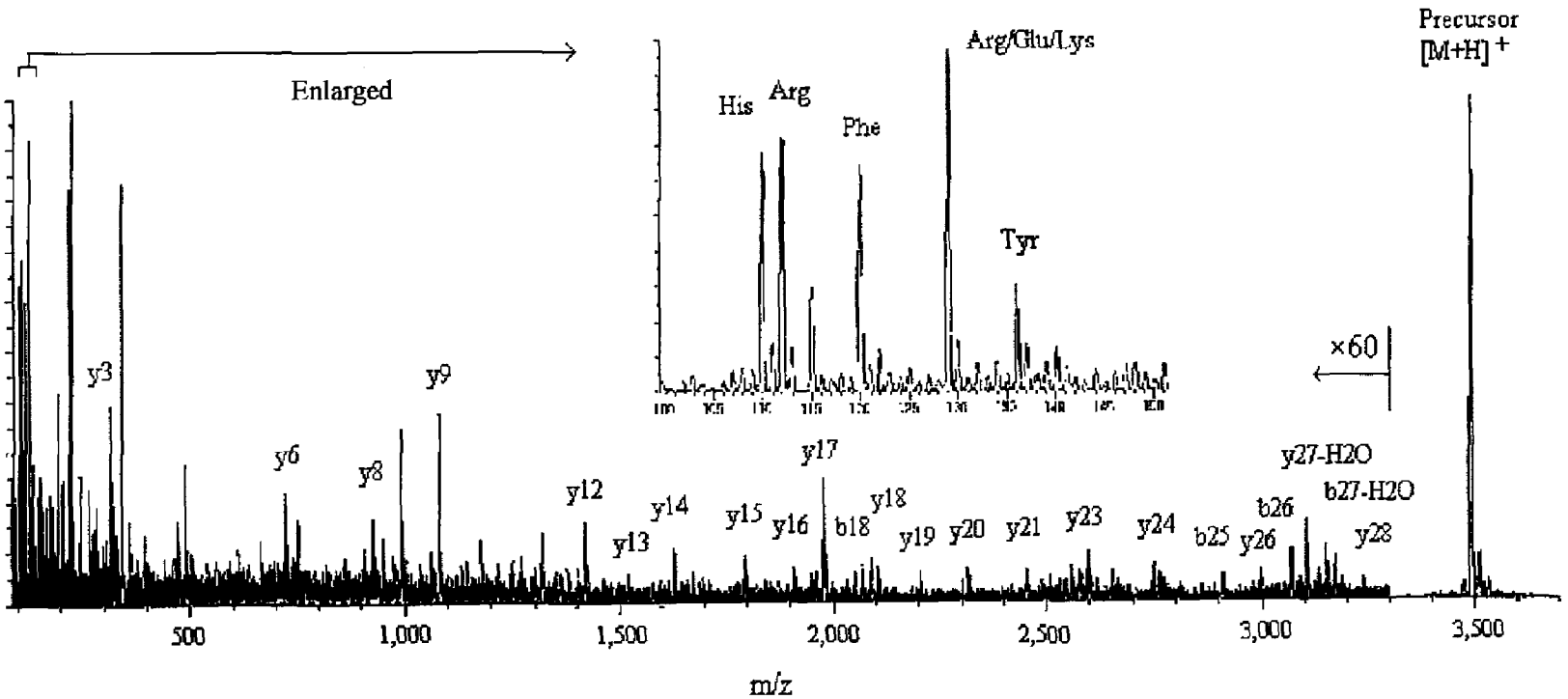
FIG. 3 is a graph showing IRMPD spectra of a monovalent ion (m/z: 3,495) of oxidized insulin B chain (bovine), wherein an inserted graph shows enlarged spectra in a m/z range of 100 to 150 Da.

The m/z value (3,495) of the precursor ion is fairly greater than the second LMCO value. This means that the precursor ion was trapped at an extremely low $q_z$ value (≈0.018) as compared with the conventional ion trap (AIT). Then, the precursor ion in a trapped state was irradiated with infrared laser light (10.6 μm). $MS^n$ spectra obtained as a result of $MS^n$ analysis are shown in FIG. 3. As seen in FIG. 3, the $MS^n$ spectra could be obtained in such a manner as to cover a wide mass range of 100 to 3,500 Da in one cycle of the $MS^n$ analysis. In a relatively low mass range (m/z: 110, 112, 120, 129, 136), immonium ions of constituent amino acids (His, Arg, Phe, Arg/Glu/Lys, Tyr) are observed. The measurement of immonium ions has a great advantage in obtaining sequence information, because constituent amino acids can be learned from the immonium ions.

As above, the mass spectrometric technique of the exemplary embodiment of the present invention provided by combining the frequency-driven ion trap with the infrared multiphoton dissociation (IRMPD) process makes it possible to cover a fairly wide mass range in one cycle of $MS^n$ analysis, as compared with the conventional technique. In addition, the mass spectrometric technique of the exemplary embodiment of the present invention makes it possible to detect small ions such as immonium ions directly from large molecules with a molecular mass of greater than 3,000 Da. This provides a great advantage in obtaining sequence information about constituent amino acids.

Exemplary embodiments of the invention has been shown and described. It is obvious to those skilled in the art that various changes and modifications may be made therein without departing from the spirit and scope thereof as set forth in the following claims.

What is claimed is:

1. An ion trap mass spectrometer for $MS^n$ analysis, comprising:

a frequency-driven ion trap section operable to trap sample ions and isolate a precursor ion from said sample ions, while setting an ion-trapping RF voltage waveform at a first frequency providing a first low-mass cutoff (LMCO) value, and, then after setting the ion-trapping RF voltage waveform at a second frequency greater than said first frequency to provide a second LMCO value less than said first LMCO value, to irradiate said precursor ion in a tapped state with light so as to photodissociate said precursor ion into fragment ions; and an analyzer section operable to subject said fragment ions ejected from said ion trap section, to mass spectrometry so as to obtain information about a molecular structure of said precursor ion.

2. The ion trap mass spectrometer as defined in claim 1, wherein said ion-trapping RF voltage waveform is formed as a rectangular voltage waveform.

3. An ion trap mass spectrometric method for $MS^n$ analysis, comprising the steps of:

trapping sample ions and isolating a precursor ion from said sample ions, while setting an ion-trapping RF voltage waveform at a first frequency providing a first low-mass cutoff (LMCO) value;

after setting the ion-trapping RF voltage waveform at a second frequency greater than said first frequency to provide a second LMCO value less than said first LMCO value, irradiating said precursor ion in a trapped state with light so as to photodissociate said precursor ion into fragment ions; and subjecting said fragment ions to mass spectrometry so as to obtain information about a molecular structure of said precursor ion.

4. The ion trap mass spectrometric method as defined in claim 3, wherein said ion-trapping RF voltage waveform is formed as a rectangular voltage waveform.

* * * * *